United States Patent [19]

Ohmori et al.

[11] 4,338,765

[45] Jul. 13, 1982

[54] METHOD FOR SEALING A CONTAINER

[75] Inventors: Koichiro Ohmori; Yasuo Tashiro; Heihachiro Nakayama, all of Tokyo, Japan

[73] Assignee: Honshu Paper Co., Ltd., Tokyo, Japan

[21] Appl. No.: 46,806

[22] Filed: Jun. 8, 1979

[30] Foreign Application Priority Data

Apr. 16, 1979 [JP] Japan ..... 54-45439

[51] Int. Cl.[3] ..... B65B 3/18; B65B 7/28; B67B 3/00

[52] U.S. Cl. ..... 53/452; 53/471; 53/478; 53/486; 53/289

[58] Field of Search ..... 53/452, 467, 471, 473, 53/478, 486, 289, 487, 488; 229/4.5, 524.8

[56] References Cited

U.S. PATENT DOCUMENTS

| | | | |
|---|---|---|---|
| 1,846,670 | 2/1932 | Barbieri | 53/486 |
| 2,225,624 | 12/1940 | Dunlap | 229/4.5 X |
| 2,329,311 | 9/1943 | Waters | 53/289 X |
| 2,467,016 | 4/1949 | Dunlap | 229/4.5 X |
| 3,103,089 | 9/1963 | Allen | 53/289 X |
| 3,140,571 | 7/1964 | Dörper | 53/373 X |
| 3,160,999 | 12/1964 | Lee | 53/486 X |
| 3,342,009 | 9/1967 | Anderson | 53/486 X |
| 3,457,694 | 7/1969 | Tatibana | 53/289 UX |
| 3,590,557 | 7/1971 | Vogel | 53/289 UX |
| 3,674,060 | 7/1972 | Ruekberg | 53/289 UX |
| 3,720,038 | 3/1973 | Bryan, Jr. et al. | 53/487 |
| 3,851,813 | 12/1974 | Smith | 229/4.5 X |
| 3,945,174 | 3/1976 | Franz | 53/317 X |
| 3,973,603 | 8/1976 | Franz | 53/289 X |
| 4,190,188 | 2/1980 | Ohmori | 229/4.5 X |

*Primary Examiner*—Horace M. Culver
*Attorney, Agent, or Firm*—Armstrong, Nikaido, Marmelstein & Kubovcik

[57] ABSTRACT

A method for sealing a cylindrical or truncated cone shaped container body the lower end of which is sealed with a base, comprising the steps of pouring a liquid into said container body through its upper open end to a predetermined level, slightly deforming upwards said base, and thereafter sealing the upper open end of said container body.

5 Claims, 16 Drawing Figures

METHOD FOR SEALING A CONTAINER

BACKGROUND OF THE INVENTION

The present invention relates to a method for sealing a cylindrical or truncated cone-like container body containing a hot or cold liquid such as milk, juice or others.

When a hot liquid is poured into a container to be sealed, two problems often occur. One of such problems will now be explained. When the hot liquid contained in the sealed container becomes cooled down to a room temperature, the volume of the liquid itself is reduced. Also, the head air space within the container becomes small in volume. As a result, the container body deforms inwards or partly sinks. This is not good for its appearance and reduces its commercial value. If a glass or metalic container is used, the air pressure in the head space of the container is merely reduced, but the container body itself does not deform, provided that no additional force is applied to the container body. In contrast thereto, the paper container does not have such a structure strength as can endure against the reduction of the air pressure of the head space within the container. Therefore, the container body made of paper deforms when the air pressure of the head space in the container is reduced. The air just adjacent to the top surface of the hot liquid in the container is relatively warm but has a lower temperature than that of the liquid immediately before the cover is sealed to the upper open end of the container body. After the sealing of the container, the air in the container becomes heated by the hot liquid and then expands. However, when the liquid becomes again cooled down to a room temperature, the volume of the head space is apt to become also smaller than that immediately after the sealing of the container. In addition, the volume of the liquid itself becomes reduced because the temperature of the liquid changes from a high temperature to a room temperature. For example, when a juice at the temperature 93° C. is poured into the container and the juice therein becomes cooled down to 20° C. after its sealing, the volume of the juice becomes reduced by about 3%, and the head space becomes reduced by about 20%. As the result, the container body partly deforms inwards to form an unshapely dent on the container body. Such deforming of the container body strikingly makes the commercial value of the goods reduced.

The other problem will be next explained. When the cover is sealed onto the upper open end of the container body, the air of the head space formed within the container becomes heated and expands by the heat of the hot liquid therein. Therefore, immediately after the sealing head is removed from the cover; the air pressure is applied to the sealed portion between the cover and the container body, whereby pinholes or leaks are apt to be formed at the sealed portion. For example, when the cover adheres to the container body of a truncated cone shape into which the juice at the temperature of 93° C. is poured, the air of the head space in the container expands by about 20% or more by the heat of the juice. Since the width of the sealing portion between the cover and the upper open end of the container body is very narrow, the pinholes or leaks for air flows are apt to be formed thereat in particular if the heat-sensitive sealing material such as polyethylene or the like remains softened immediately after its sealing. Such phenomenon often occurs if the temperature of the liquid immediately after its pouring into the container is close to the softening temperature of the resin laminated on the upper end of the container body for the purpose of sealing.

SUMMARY OF THE INVENTION

Therefore, it is a primary object of the present invention to provide in view of the aforementioned aspects a method for making a sealed container in which no pinholes or leaks are formed at the sealing portions by the heat expansion of the head space in the container when the upper open end of the container body in which the hot liquid is contained is sealed.

It is another object of the present invention to provide a method for sealing a container which does not deform inwards when the poured liquid changes from its high temperature to its room temperature.

According to the present invention, there is provided a method for sealing a cylindrical or truncated cone shape container body the lower end of which is sealed with a base, comprising the steps of pouring a liquid into said container body through its upper open end to a predetermined level, slightly deforming upwards said base, and thereafter sealing the upper open end of said container body.

It is preferable that the container body is conveyed to a proper position while the base slightly deforms downwards. In one aspect of the present invention, the upper open end of the container body is sealed with a cover made of sheet material. In another mode of the present invention, the upper open end of the container body is folded and superposed to be sealed to each other without any cover member.

The base may forcibly or naturally deform downwards in order to increase the depth of the head space from the top surface of the poured liquid to the top end of the container body, before or after, or simultaneously when the liquid is poured into the container body.

BRIEF DESCRIPTION OF THE DRAWINGS

These and other objects, features and advantages of the present invention will become more apparent from the following description of preferred embodiments of the present invention taken in conjunction with the accompanying drawings in which.

DETAILED DESCRIPTION OF THE PREFERRED EMBODIMENTS

Figure 1:
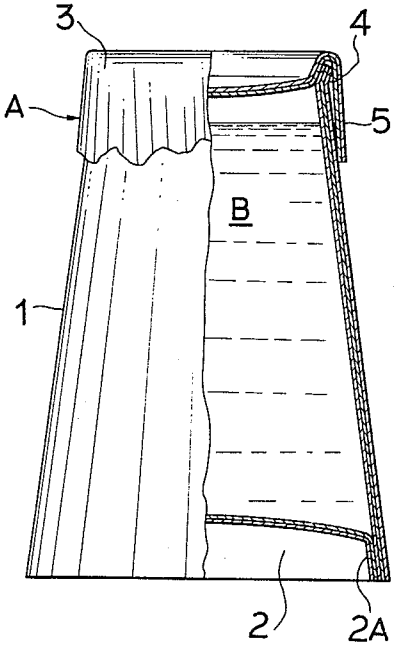
FIG. 1 is a view partly in section of a sealed container according to a preferred embodiment of the present invention in which a liquid is contained.

Referring now to FIG. 1, there is generally shown a sealed container A made according to an embodiment of the present invention. The container A comprises a container body 1, a base 2 and a cover 3. Poured into the container A is a desired liquid such as hot juice or alcoholic drinks which are pasteurized. Such a liquid is naturally or forcibly cooled down after the complete sealing of the container A. A temperature of the poured liquid ranges from about 50° C. to 90° C. when it is poured into the container. The container body 1 is formed like a hollow truncated cone or cylinder. The container body 1 is made mainly of paper sheet which has an air-tightness. Such paper sheet is, for example, a paper, synthetic paper or board on which a heat-sealable thermoplastic material is laminated or a heat-sensitive or pressure-sensitive adhesive is coated. The base 2 is formed like a disk. The base 2 is made of such sheet material as has the same or less strength as compared with that of the container body 1. The sheet material for the base 2 is one which has an air-tightness, for example, a paper, plastic film, aluminum foil or a combination thereof on which a heat-sealable material is coated. The periphery 2A of the base 2 is folded to form a flange-like portion on the outside of which the inner surface of the lower end of the container body 1 is sealed. The central portion 2B of the base 2 is slightly indented or deforms upwards. The cover 3 is made of such sheet material as can adhere to the inner surface of the upper open end of the container body 1. Such a sheet material is, for example, an aluminum foil, polyester sheet, paper or a combination thereof on which a heat-sensitive resin such as polyethlene is laminated. The cover 3 can be formed like a disk, square or any other figure. The cover 3 is usually sealed onto a marginal upper portion of the container body 1 flared outwards.

Figure 2:
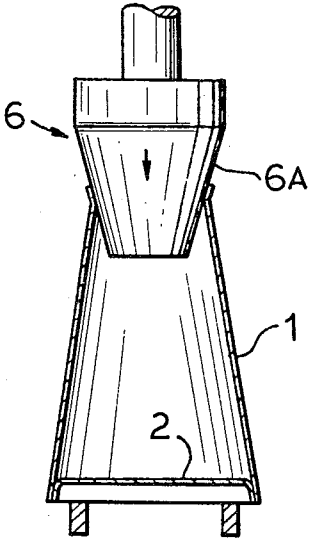
FIG. 2 is a sectional view of a container body with its lower end being sealed with a base and illustrates a step during which the upper open end of the container body is slightly widened.

A method of making the sealed container A as above-mentioned will be now explained. First, the base is sealed onto the lower end of the container body 1. At this first step, usually, the base 2 is plane and flat as shown by the full line in FIG. 2, or slightly sinks as shown by the chain line in FIG. 2. Next, the upper open end of the container body 1 is slightly widened to form a flared marginal portion. For example, a tapered tip 6A of a preliminary sealing head 6 is pushed into the upper open end of the container body 1 so as to widen slightly the upper end of the container body 1. It is preferable that the tip 6A of the preliminary sealing head 6 has its small taper angle and relatively long length. When the container body 1 is cylindrical or only slightly tapered, it is not necessary to widen preliminarily the upper open end of the container body 1.

Figure 3:
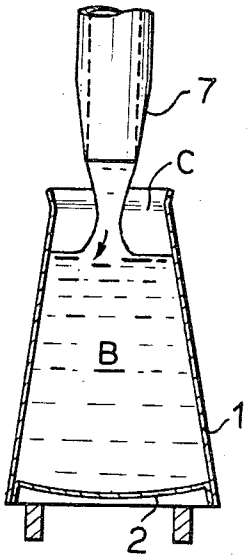
FIG. 3 illustrates a step in which a desired liquid is poured into the container body so that the base deforms downwards or sinks.
Figure 13:
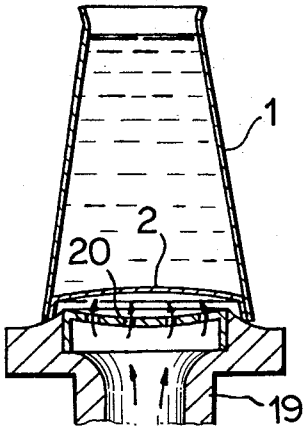
FIG. 13 is a sectional view showing a modified container according to another embodiment of the present invention.

FIG. 3 indicates the next step during which a desired hot liquid B is poured through a nozzle 7 into the container body 1 to a predetermined level. The nozzle 7 is connected through pipe means to liquid feeding means (not shown) in a conventional manner. When the liquid B is contained in the container body 1, the base 2 deforms downwards by the weight of the liquid B. If desirable, the base 2 may be forcibly dented by such means as shown in FIG. 13 or other means before the liquid is put into the container, in particular if the base 2 is made of a strong material. The depth of the dent on the base 2 is preferably selected in view of the kind of the liquid B to be poured, its temperature, or the volume of a head space formed in the upper portion of the container body 1. For example, the base is sunk by 3 mm if an orange juice of about 90° C. is put into a cylindrical container body with its volume of 200 ml the upper opening of which has its diameter of 60 mm.

Figure 4:
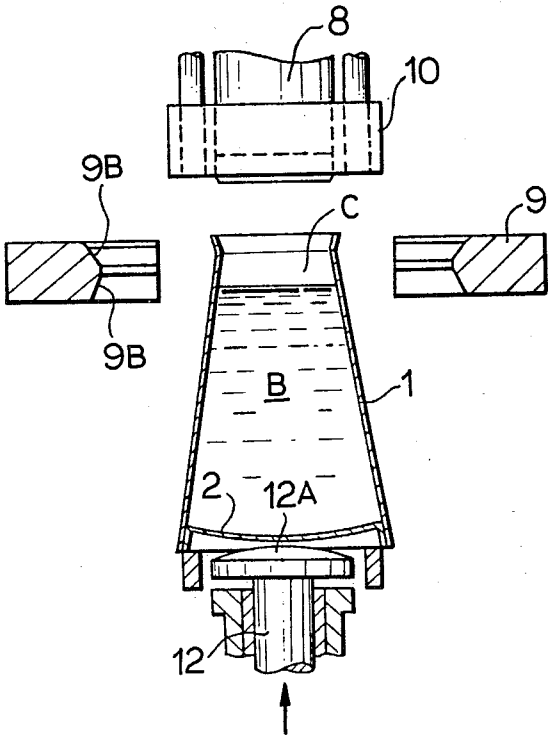
FIG. 4 illustrates a step at which the container body is held in position but the base still remains sunk.

As a step as shown in FIG. 4, the container body 1 in which the liquid B is contained is held in position by a die 9. The die 9 consists of two halves which are designed to selectively combine or separate from each other. The halves of the die form, when combined, a hole for retaining the upper portion of the container body 1. The die has a tapered wall 9A at its lower portion and a reverse-tapered wall 9B at its upper portion adjacent thereto. The tapered portion 9A of the die 9 is designed to retain thereon the outer surface of the container body 1.

Figure 5:
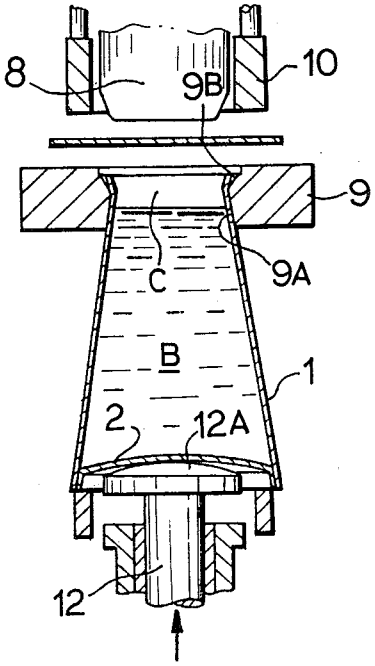
FIG. 5 illustrates a step in which the base deforms upwards while a cover is set over the upper open end of the container body.

FIG. 5 shows a condition in which the die 9 is closed to hold the upper portion of the container body. While the container body 1 is thus held in position by the die 9, a forcing member 12 moves up to a predetermined position so as to push up the central portion of the base 2 by the curved surface 12A of the forcing member 12. The depth of the dent on the base 2 is properly selected in view of the kind of liquid to be poured, its temperature or the volume of the head space C formed in the upper portion of the container body 1. For example, if the orange juice of about 90° C. is put into the cylindrical container body having the volume of 200 ml with its upper opening of 60 mm in diameter, the head space C has the volume of about 10 c.c. In this case, the center of the base 2 deforms upwards by about 3 mm.

On the other hand, the cover 3 is set over the upper open end of the container body 1.

Figure 6:
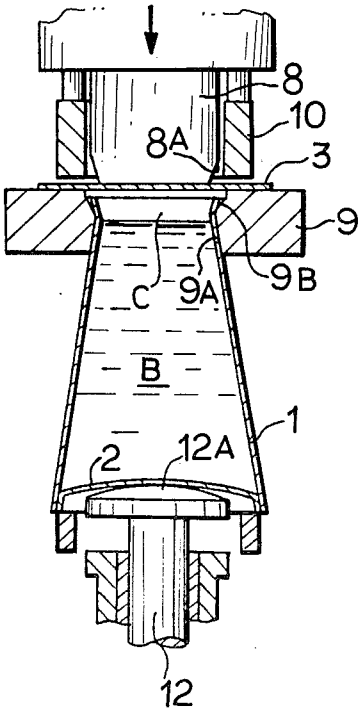
FIG. 6 illustrates a step in which a sealing head starts depressing the cover onto the upper open end of the container body.
Figure 7:
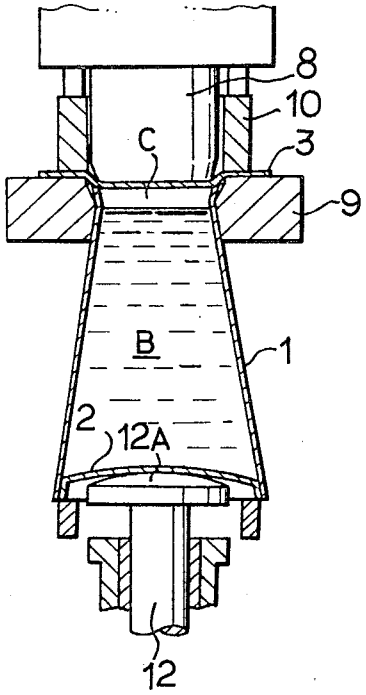
FIG. 7 illustrates a step in which the cover is slightly depressed downwards into the upper open end of the container body.

FIG. 6 indicates a step during which a sealing head 8 depresses the cover 3 to some minor degree. The lower portion of the sealing head 8 has a taper 8A corresponding to the reverse-tapered wall 9B of the die 9. Movably provided around the sealing head 8 is a ring 10 for holding the marginal edge of the cover 3 between the ring 10 and the die 9 when the tip of the sealing head 8 depresses the cover 3 into the top opening of the container body 1. That is to say, as shown in FIG. 7, the marginal periphery of the cover 3 is held between the ring 10 and the die 9, and then the sealing head 8 depresses the cover 3 into the top opening of the container body 1.

Figure 8:
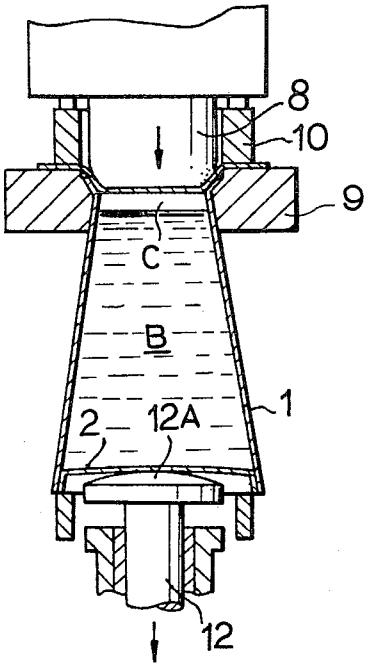
FIG. 8 illustrates a step in which the cover is completely sealed onto the upper open end of the container body.

FIG. 8 shows a condition in which the cover 3 is further depressed into the top opening of the container body 1. The annular portion of the cover 3 becomes in contact with the inner surface of the upper edge of the container body 1 the edge of which is supported by the die 9. The upper edge of the container body 1 and the annular portion of the cover 3 are pressed to each other between the reverse-tapered wall 9B and the taper 8A of the sealing head 8. As a result, the cover 3 is bonded to the inner surface of the upper edge of the container body 1. At the same time, the upper edge of the container body 1 is widened or flared outwards along the reverse-tapered wall 9B.

Figure 9:
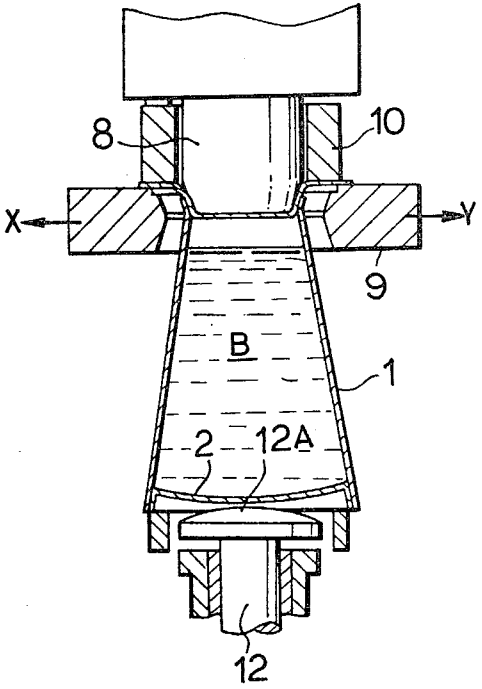
FIG. 9 illustrates a step during which the halves of a die separate to each other and a forcing member moves down so that the base deforms downwards.

Thus, as illustrated in FIG. 9, the central portion of the base 2 deforms downwards or sinks because the forcing member 12 drops. Since the base 2 is sunk, the heat expansion of the air in the head space C by the hot liquid B is absorbed so as to prevent pinholes or leaks from occuring on the sealed portion between the cover 3 and the container body 1. On the other hand, the two halves of the die 9 separate from each other in a direction of arrows X and Y, respectively. Thereafter, the sealing head retracts upwards away from its lower position.

Figure 10:
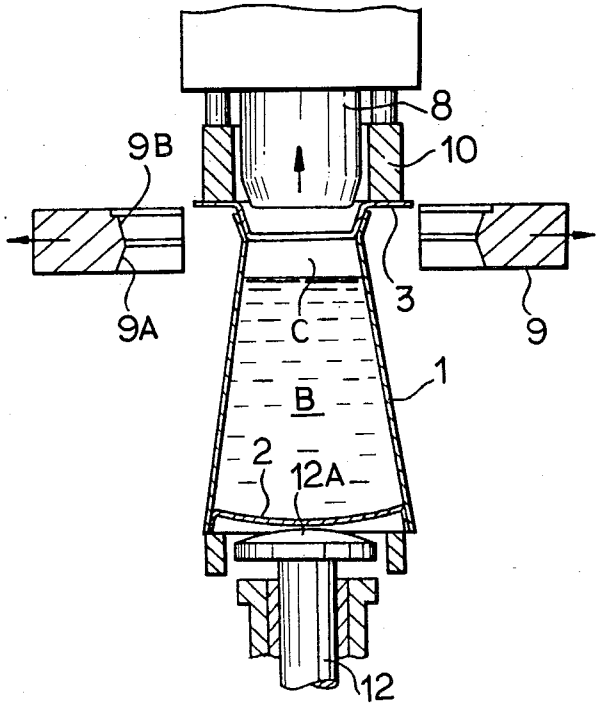
FIG. 10 illustrates that the sealing head and the die become completely separate from the cover.

As illustrated in FIG. 10, when the sealing head 8 has completely separated from the cover 3, the central portion of the cover 3 may slightly deform upwards by the heat expansion of the air in the head space C which could not be absorbed although the base 2 deforms downwards so as to increase the volume of the head space C.

Figure 11:
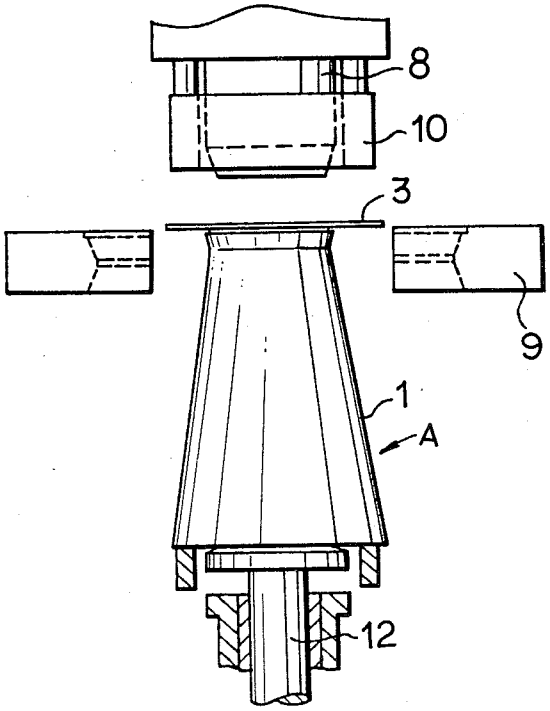
FIG. 11 illustrates that the sealing head and the die comes back to their original positions, respectively.

At a step as shown in FIG. 11, the sealing of the cover 3 with the container body 1 is completed, and the sealing head and the halves of the die 9 have come back to their original positions. After the forcing member 12 drops back to its original position, the sealed container is conveyed to a next stage.

When the liquid B contained in the sealed container A becomes cooled down to a room temperature, the head space C in the container as well as the liquid B itself reduce in volume. As a result, the base 2 deforms upwards slightly while the cover 3 becomes slightly sunk, for example, as illustrated in FIG. 1. Consequently, the container body does not deform but can hold its original good figure.

Figure 12:
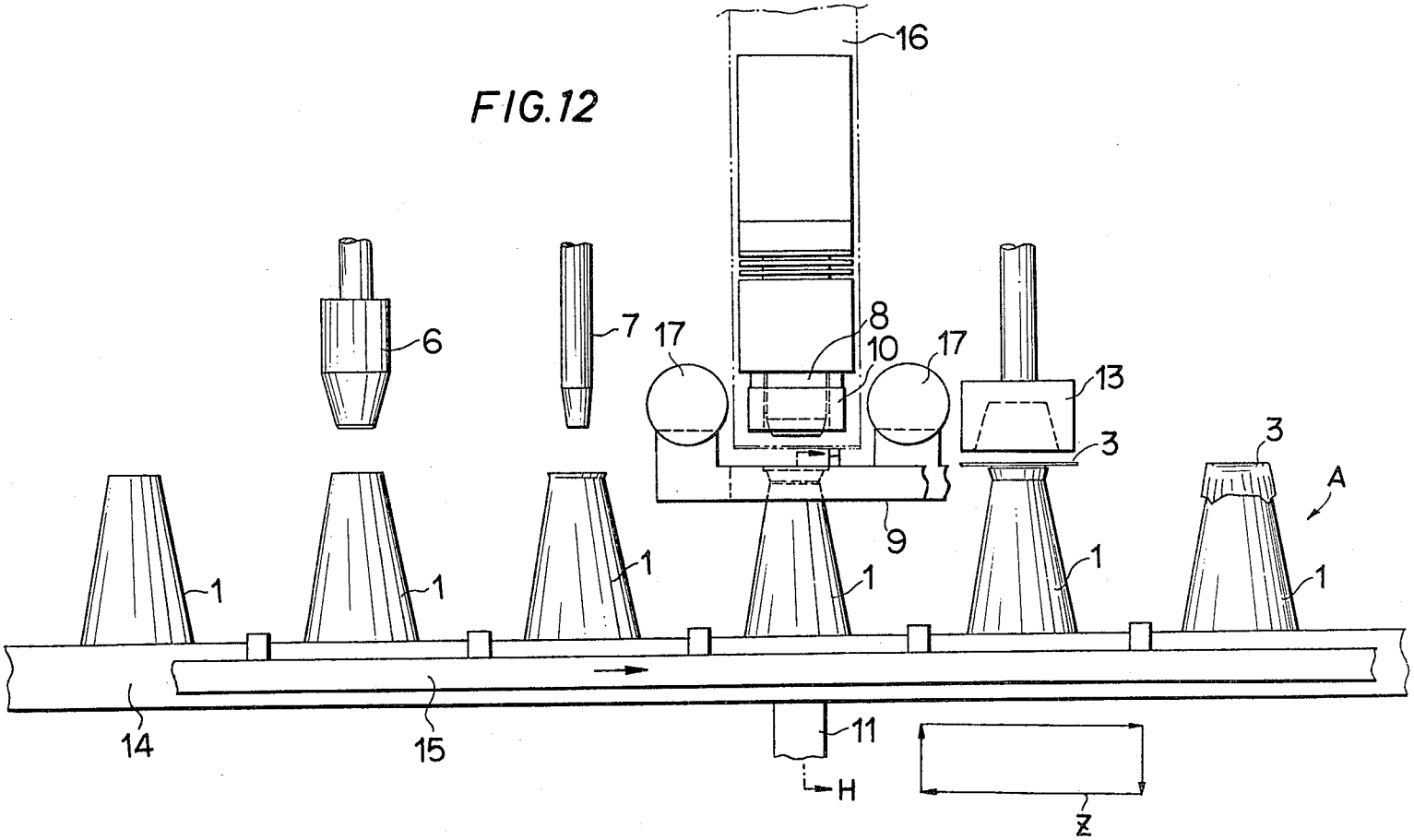
FIG. 12 is a schematic front view of a machine for practicing a method of the present invention.

FIGS. 12 and 13 illustrate an apparatus for carrying out a sealing method according to an embodiment of the present invention. Two rails 14 are horizontally arranged in parallel with each other. A centipede type of conveyer 15 is so provided along the rails 14 that it may circulate along a rectangle course as designated by the arrow Z. A series of container bodies 1 are arranged on the rails 14 and conveyed in a direction of right hand by the intermitent movement of the conveyer 15. The preliminary sealing head 6, the nozzle 7, the die 9 and a skirt-like member 13 are provided respectively in position in the sealing apparatus at each pitch of the intermitent movement of the conveyer 15. A long sheet material 16 is cut or punched out by a cutter or the like (not shown) provided behind the sealing head 8, thereby to produce a desired shape of bases 3. Each of such bases 3 is fed appropriately in position between the sealing head 8 and the die 9 when required. The halves of the die 9 are actuated by a die-actuating mechanism generally designated by 17 so as to close or separate selectively to each other if required. The skirt-like member 13 is so arranged that it may move up and down. By such movement of the skirt-like member 13, the periphery of the cover 3 is bent downwardly, thus becoming the figure of the sealed container A as illustrated in FIG. 1. A guide member 11 and the forcing member 12 are arranged coaxially under the sealing head 8. The forcing member 12 may slidably move up and down in the guide member 11. A mechanism for actuating the forcing member 12 is not shown because any well-known one can be used therefor.

FIG. 13 illustrates a modified forcing member for deforming upwards or downwards a base. The forcing member 19 has several small openings 20 formed on the top thereon, through which the pressurized air is blown onto the under surface of the base 2 so that the base 2 deforms upwards. If required, the forcing member 19 can be utilized for the purpose of sinking or deforming downwards of the base 2 by producing a vacuum in the space within the forcing means 19.

Figure 16:
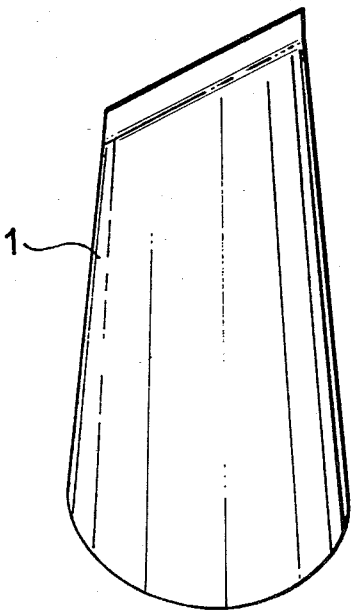
FIG. 16 is a perspective view of still another embodiment of the present invention.
Figure 14:
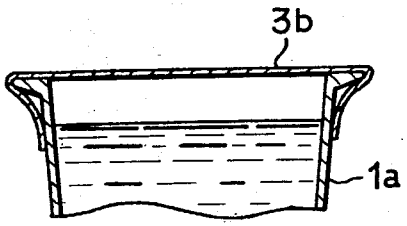
FIG. 14 is a vertical section, partly cut, showing another modification of the top portion of a sealed container according to still another embodiment of the present invention.
Figure 15:
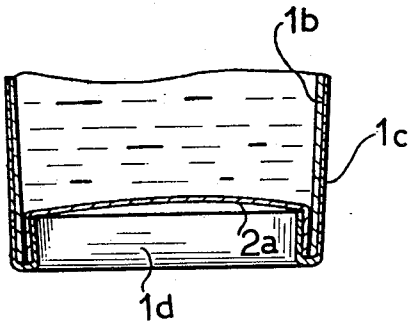
FIG. 15 is a vertical section illustrating the bottom of a sealed container according to still yet another embodiment of the present invention.

The present invention is not limited to the sealed container of the shape as above-mentioned. For example, a cover **3*b* may be adhered to the upper open end of a container body 1*a* in such a manner as illustrated in FIG. 14. Also, according to another embodiment of the present invention as shown in FIG. 15, the periphery of a base 2*a* is bonded onto the inner surface of the lower end of a container body 1*b*, and the bent lower end of the base 2*a* is covered by a folded end 1*d* of a thin paper sheet 1*c* or the like superposed on the outer side of the container body 1*b*. According to still another embodiment of the present invention as shown in FIG. 16**, the upper open end of a truncated cone-like body is superposed at its marginal edge to be adhered to each other for the sealing thereof.

According to a sealing method of the present invention, as seen from the foregoing, the heat expansion of the head space in the sealed container by the hot liquid poured into the container can be effectively absorbed. Also, the reduction in volume of the head space and the liquid within the container can be properly absorbed when the contained liquid becomes cooled down. Consequently, the container body never deforms to reduce its commercial value. In addition, no pinholes or leaks occur on the sealed portions of the cover and the container body.

Since the central portion of the base 2 slightly deforms upwards before the cover 3 is adhered to the upper open end of the container body, the head space C in the top of the container body is reduced. This is mostly effective for the purpose of reducing the heat expansion of the air in the sealed container by the hot liquid. On the other hand, when or before the liquid is put into the container body, the base 2 deforms downwards to increase the head space defined by the inner wall of the container body and the surface of the liquid contained therein, in other words, the depth from the upper end of the container body to the surface of the liquid. This is useful in order to prevent the liquid from flowing over the upper end of the container body particularly when it is conveyed.

The present invention may be also applied to a sealing method in which a cold liquid is poured into a container body with its bottom open end being sealed with a base.

While the preferred embodiments of the present invention have been particularly shown and described using specific terms, such is for illustrative purposes only, and it is to be understood that these and other changes and variations may be made without departing from the spirit or scope of the following claims.

What is claimed is:

1. A method for sealing a cylindrical or truncated cone-like container body including a paper material as a main structure material, the lower end of which is sealed with a base, comprising the steps of:

pouring a hot liquid into said container body through its upper open end to a predetermined level;

slightly deforming upwards said base while not deforming said container body;

thereafter sealing the upper open end of said container body while said base is deformed upwards;

permitting said base to deform outwardly or downwardly due to the weight of the liquid and a high gas pressure created by the hot liquid in the head space within said container body;

and permitting said base to deform inwardly or upwardly due to vacuum within the head space as the liquid cools;

whereby no pinholes or leaks are formed at the sealed portion of the upper end of said container body and a good appearance of said container body is obtained.

2. A method of sealing a cylindrical or truncated cone-like container body including a paper material as a main structural material, the lower end of said container body being sealed with a base, said base being formed in a circular cap shape and fixed at a skirt periphery thereof onto the inner surface of the lower end of said container body in such a manner that the circular central portion of said base is positioned at the top of said base and the skirt periphery of said base extends downwardly where said base is bonded onto said container body, comprising the steps of:

deforming said base downwardly in such a manner that said base is largely bent at a connecting portion between the central portion and the skirt periphery of said base so as to become a concave lens shape whereby said base can easily be deformed to function as bellows within an idling space at the lower end of said container body thereafter;

pouring a hot liquid into said container body through its upper open end to a predetermined level;

thereafter deforming slightly said base upwardly so as to have the surface of the hot liquid move up while said container body is maintained in its original form;

immediately thereafter sealing the upper open end of said container body with a cover;

permitting said base to deform outwardly or downwardly due to a high gas pressure created by the hot liquid in the head space within said container body; and permitting said base to deform inwardly or upwardly when the liquid cools;

whereby said base can function as bellows to absorb the volume change of the liquid and head space within said container body sealed with said base and said cover so that no pinholes or leaks are formed at the sealed portion of the upper end of said container body and said container body can be always maintained in its original good shape.

3. A method of sealing a cylindrical or truncated cone-like container body including a paper material as a main structural material, the lower end of said container body being sealed with a base, said base functioning as bellows except the portion thereof bonded to the container body, comprising the steps of:

pouring a hot liquid into said container body through its upper open end to a predetermined level;

thereafter deforming slightly said base upwardly so as to have the surface of the hot liquid move up;

immediately thereafter sealing the upper end of said container body with a cover by applying heat thereto;

releasing said base immediately thereafter thereby permitting said base to deform outwardly or downwardly due to the weight of the hot liquid and a high gas pressure created by the hot liquid in the head space within said container body so that pinholes can be prevented from being formed at the sealed portion of the upper end of the container body, and then permitting said base to deform inwardly or upwardly as the liquid cools, until the vacuum in the head space balances atmospheric pressure, so that said container body can be prevented from being deformed.

4. The method of claim 1, 2 or 3, wherein a temperature of the liquid ranges between 60° C. and 95° C. when it is poured into said container body.

5. The method of claim 1, 2, or 3, wherein said base is made of a paper, an aluminium foil, a plastic sheet or a combination thereof, on which a thermoplastic resin is laminated or coated.

* * * * *